United States Patent [19]

Klebba

[11] 4,166,645

[45] Sep. 4, 1979

[54] DOOR LATCHING APPARATUS FOR A VEHICLE DOOR

[75] Inventor: Horst Klebba, Weyhausen, Fed. Rep. of Germany

[73] Assignee: Volkswagenwerk Aktiengesellschaft, Wolfsburg, Fed. Rep. of Germany

[21] Appl. No.: 921,324

[22] Filed: Jul. 3, 1978

[30] Foreign Application Priority Data

Aug. 20, 1977 [DE] Fed. Rep. of Germany ..... 2737639

[51] Int. Cl.[2] ..... E05C 3/26

[52] U.S. Cl. ..... 292/216

[58] Field of Search ..... 292/216, 280, DIG. 26, 292/DIG. 24

[56] References Cited

U.S. PATENT DOCUMENTS

| | | | |
|---|---|---|---|
| 2,849,250 | 8/1958 | Williamson | 292/92 |
| 2,961,265 | 11/1960 | Jakeman et al. | 292/216 |
| 3,620,560 | 11/1971 | Peters | 292/216 X |
| 3,929,361 | 12/1975 | Klebba | 292/216 |

*Primary Examiner*—Richard E. Moore
*Attorney, Agent, or Firm*—Brumbaugh, Graves, Donohue & Raymond

[57] ABSTRACT

Door latching apparatus, specifically for a vehicle sliding door, includes a turning latch, rotatable between a closed and an open position, rigidly connected with a blocking lever having a tab which extends into a slot in a pivot lever. A movable operating lever has a contact area arranged in sliding contact with first and second surfaces of the pivot lever such that, when the turning latch is in an open position, the contact area is in contact with the first edge surface, thereby releasing the pivot lever, and when the turning latch is in a closed position, the contact area is in contact with the second edge surface, thereby locking the pivot lever.

6 Claims, 3 Drawing Figures

DOOR LATCHING APPARATUS FOR A VEHICLE DOOR

BACKGROUND OF THE INVENTION

The present invention relates to a door-latch apparatus and, more particularly, to a door-latching mechanism for the sliding door of a motor vehicle.

Door latching apparatus, specifically for a vehicle sliding door, is disclosed in the U.S. Pat. No. 3,929,361 to Horst Klebba. This mechanism includes a turning latch, rotatable between a closed and an open position, rigidly connected with a blocking lever having a tab which extends into a slot in a pivot lever. A spring biases the pivot lever in a direction urging the blocking lever, and thereby the turning latch, into the open position. A movable operating lever has a contact area arranged in sliding contact with first and second surfaces of the pivot lever such that when the turning latch is in an open position, the contact area is in contact with the first edge surface, thereby releasing the pivot lever, and when the turning latch is in a closed position, the contact area is in contact with the second edge surface, thereby locking the pivot lever. A second spring biases the operating lever in a direction urging the operating lever into the position in which the pivot lever is locked.

In this particular door-latching mechanism, both the angle at which the two edge surfaces of the pivot lever meet and the angle formed by the contact area of the operating lever are acute angles. When turned to the open position, the acute-angled edge surfaces of the pivot lever slip into a cut-out below the acute-angled contact area of the operating lever, while in the opposite case, when the turning latch is in the closed position, the contact area of the operating lever holds the acute-angled edge surface of the pivot lever.

In a door latching mechanism of this general type there is a danger that the turning latch will return to the closed position when it should be caused to open. Because of friction, the contact area of the operating lever cannot slide freely over the edge surfaces of the pivot lever. This friction produces a torque about the pivot shaft of the pivot lever which counteracts the motion of the pivot lever from the closed position to the open position when the turning latch moves. In the case of the door latch according to the above-noted patent, this resistance to opening is prevented by providing a suitable bend in the first edge surface of the pivot lever such that the force exerted on it by contact area of the operating lever produces a torque in the direction of opening.

SUMMARY OF THE INVENTION

It is a general object of the present invention to provide a door latch of the type described above having parts which move from their closed to their open position with very little application of force.

It is a more specific object of the present invention to provide a door latch of the above-described type having a pivot lever and an operating lever in which the moments of force caused by friction between the edge surfaces of the pivot lever, on one hand, and the contact area of the operating lever on the other, in relation to the pivot axis of the pivot lever are maintained as small as possible.

These objects, as well as other objects which will become apparent from the discussion that follows, are achieved, according to the present invention by (1) arranging the first and second edge surfaces of the pivot lever in a plane passing to one side of the end face of the pivot shaft of the pivot lever; (2) arranging the contact area of the operating lever in the aforementioned plane such that the contact area moves along a path, in the region of the pivot shaft of the pivot lever, extending approximately radially with respect to the axis of this pivot shaft; and (3) constructing the first edge surface of the pivot lever adjacent to the pivot shaft thereof so that it extends, at least approximately, in a circular arc about this pivot shaft.

The fact that the operating lever or its contact area moves in a plane to one side of the front face of the pivot shaft of the pivot lever makes it possible to locate the first edge surface of the pivot lever, which is used when the turning latch is in its open position, such that the friction, which unavoidably arises between this surface and the contact area of the operating lever, produces only very small torques on the pivot lever. It is particularly advantageous that this characteristic of the door latch according to the invention is attained not through great expense in design or construction, but rather with very simply shaped levers, where care is taken to see that the first edge surface, in spite of its position directly adjacent to the pivot shaft of the pivot lever, be accessible to the contact area of the operating lever. Various other design features of the door latch in accordance with the invention, which will be described below, also result in a simple construction.

The U.S. Pat. No. 2,849,250 discloses a door latch, intended particularly for refrigerators, in which the pivot lever also exhibits an edge surface in the region of its pivot shaft which corresponds approximately to the first edge surface in this invention. A second edge surface is present which is in contact with a bar, sometimes covered with a roller, when the door is closed. This known latch design is usable only in special cases, however; namely, when it is possible to dispense with stops which will immobilize or block the different components of the latch in the closed position. Both edge surfaces in this known design are components of an angle-shaped slot which accepts the bar, with or without the roller. The arrangement of the area which forms the second edge surface of this slot is located with respect to the pivot shaft of the pivot lever such that, when sufficient force is exerted on the door, the turning latch can be turned to its open position against the closing force exerted by a spring on the operating lever.

DESCRIPTION OF THE PREFERRED EMBODIMENTS

Figure 1:
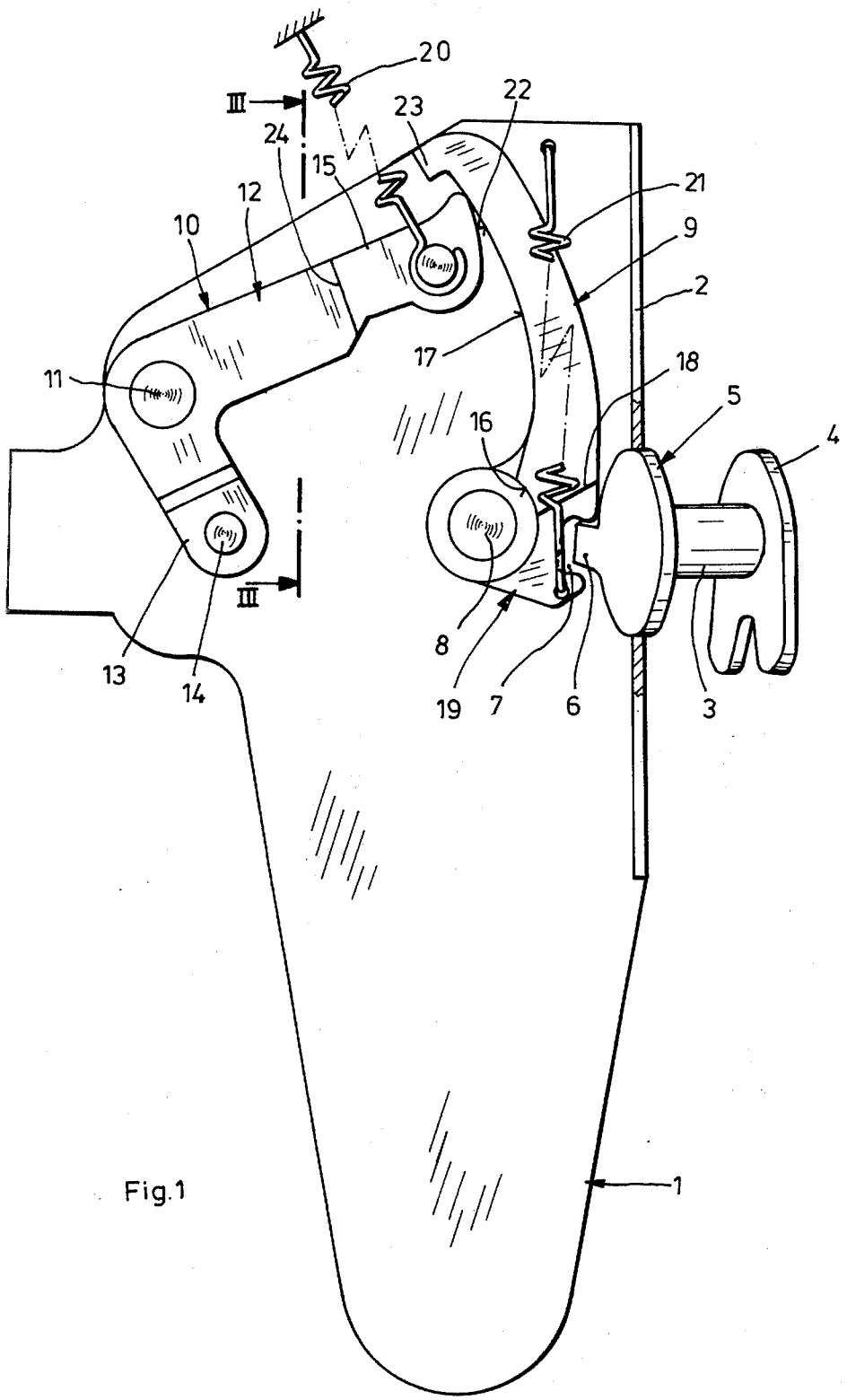
FIGS. 1 and 2 of the drawing are elevational views of a latch mechanism according to a preferred embodiment of the invention as viewed from the inside of the door showing the parts of the mechanism in their locking and their opening positions, respectively.

The essential components of the door latching mechanism according to the present invention are shown in FIG. 1. A lock support member 1 of sheet metal serves for mounting the lock on the door and, in addition, as a bearing surface for several pivot shafts to be described below. This support member 1 has a face plate 2 which is bent upwards in a direction approximately perpendicular to the plane of the drawing, shown in the figure as partially cut away. The face plate provides a bearing surface for a shaft 3 on which are rigidly mounted both a turning latch 4 of conventional design and a blocking lever 5. A tab 6 on the blocking lever 5 protrudes into a slot or fork 7 of a pivot lever 9 which rotates on a pivot shaft 8. Another essential component of the latching mechanism is an operating lever 10 which rotates on another shaft 11. The operating lever 10 has two arms 12 and 13 that form an angle of approximately 90° with respect to each other. One arm 13 is attached to an actuating rod by means of a pin 14, while the other arm 12 has a contact area 15 on its free end which is in contact with one of two edge surfaces 16 and 17 of the pivot lever 9. As indicated by the bending edge 24, the end of the arm 12 having the contact area is bent above the plane of the front face of the pivot shaft 8 of the pivot lever 9; i.e., outward toward the viewer with respect to the plane of the drawing.

The pivot lever 9 also occupies two planes: namely, (1) the area in the drawing above the bending edge 18 and forming the edge surfaces 16 and 17 is located in the same plane as the contact area 15 of the operating lever 10 (therefore in front of or toward the viewer from the end of the pivot shaft 8), and (2) the area 19 bearing the fork 7 and an aperture for passage of the shaft 8 are behind the plane of the edges 16 and 17.

Tension springs 20 and 21 are attached to the operating lever 10 and the pivot lever 9, respectively. The spring 21 applies a biasing force to the pivot lever 9 tending to turn the turning latch 4 into its open position.

The position of the operating lever 10 shown in FIG. 1, which is the position it will tend to assume due to the effect of the tension spring 20, is its locking position; here it locks or latches the pivot lever 9 through contact with the second edge surface 17 thereof. Only the rotation of the operating lever 10 by hand into its release position—the position shown in FIG. 2 and designated as 10'—makes possible the opening of the door. In this position of the operating lever the tension spring 21 can rotate the pivot lever 9 about its pivot shaft 8 in the counterclockwise direction as viewed in the drawing into the position 9' shown in FIG. 2. In this case, the first edge surface 16 of the pivot lever 9 acts as the contact surface for the contact area 15 of the operating lever 10. This first surface 16 lies approximately on a circular arc around the rotational shaft 8 of the pivot lever 9—in particular, on an arc with a very small radius—so that the forces due to friction between the edge surface 16 on the one hand and the approximately linear part (extending perpendicularly to the plane of FIGS. 1 and 2) of the contact area 15 on the other can exert only very small torques on the pivot lever 9 about its pivot shaft 8.

Figure 2:
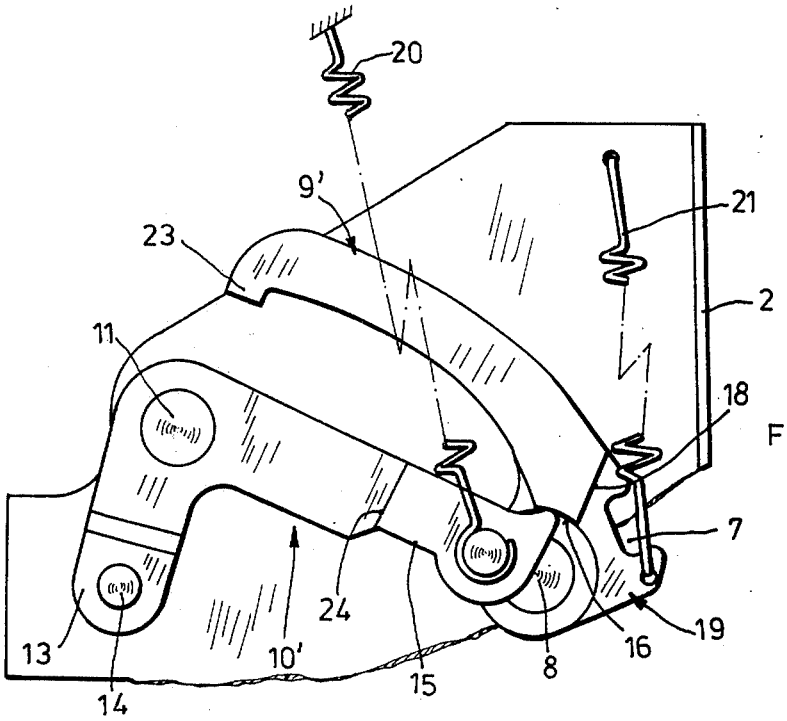
Figure 3:
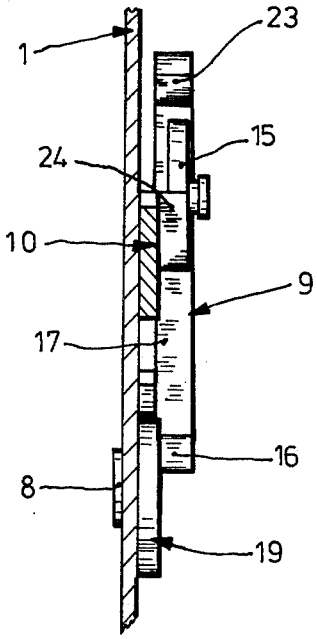
FIG. 3 is the sectional view indicated at III—III in FIG. 1.

On the other hand, as can be seen from FIG. 1, in the locking position of pivot lever 9 the second edge surface 17 runs approximately along a circular arc with its center at the axis of the pivot shaft 11 of the operating lever 10 when the turning latch 4 is in the closed position. This arc extends approximately radially outward from the axis of the pivot shaft 8. A slight taper is superimposed on the arc so that the edge surface 17, at its end region farthest from the pivot shaft 8—i.e., at about the position indicated at 22—is displaced somewhat in the direction of the pivot shaft 11 of the operating lever 10. In this way the rotation of the operating lever from the position shwon in FIG. 1 into the position indicated at 9' in FIG. 2 is at first assisted somewhat by a force applied by the surface 17. This taper also has the effect of supporting the closing movement of the turning latch in the last closing phase by means of the spring 20.

Obviously, springs 20 and 21 can also be in the form of coil springs around the pivot shafts. For reasons of safety, in this example the free end of the pivot lever 9 is shown as a stop hook for the operating lever 10.

While there has been described what is believed to be the preferred embodiment of the invention, those skilled in the art will recognize that various changes and modifications may be made thereto without departing from the spirit of the invention, and it is intended to include all such embodiments as fall within the true scope of the invention.

I claim:

1. In apparatus for latching a door, particularly a vehicle sliding door, said apparatus comprising:

(a) a turning latch rotatable between an open and a closed position;

(b) a pivot lever rotatable about a pivot shaft and having a fork, a first edge surface and a second edge surface, said first and second edge surfaces being adjacent and contiguous and forming an angle with respect to each other;

(c) a blocking lever connected to rotate with said turning latch, said blocking lever having a tab protruding into said fork of said pivot lever;

(d) a first spring biasing said pivot lever in a direction urging said blocking lever, and thereby said turning latch, into the open position;

(e) a movable operating lever having a contact area arranged in sliding contact with said first and second edge surfaces of said pivot lever, such that when said turning latch is in an open position, said contact area is in contact with said first edge surface thereby releasing said pivot lever, and when said turning latch is in a closed position, said contact area is in contact with said second edge surface, thereby locking said pivot lever; and (f) a second spring biasing said operating lever in a direction urging said operating lever into the position locking said pivot lever;

the improvement wherein said first and second edge surfaces lie in a plane passing to one side of the end of the pivot shaft of said pivot lever; wherein said contact area of said operating lever is arranged in said plane and moves along a path, in the region of said pivot shaft, extending approximately radially with respect to the axis of said pivot shaft; and wherein said first edge surface of said pivot lever is adjacent said pivot shaft and extends, at least approximately, in a circular arc about said pivot shaft.

2. Door latching apparatus as defined in claim 1, wherein the fork of said pivot lever lies in a common plane with the portion of said pivot lever surrounding said pivot shaft.

3. Door latching apparatus as defined in claim 1, wherein said second edge surface of said pivot lever lies in a substantially circular arc around the pivot shaft of said operating lever when said turning latch is in its closed position.

4. Door latching apparatus as defined in claim 3, wherein said second edge surface has an end region extending away from the pivot shaft of said pivot lever, which is displaced slightly from said circular arc in the direction of said pivot shaft of the operating lever.

5. Door latching apparatus as defined in claims 3 or 4, wherein said second edge surface has an end region extending away from the pivot shaft of said pivot lever, which terminates in a stop hook for the contact area of said operating lever.

6. Door latching apparatus as defined in claim 1, wherein said operating lever has two arms, one forming said contact area and the other connected to receive the operating force for the door latching apparatus, said two arms forming an angle of approximately 90° between them which faces said pivot lever when said turning latch is in its closed position.

* * * * *